US005761875A

United States Patent [19]

Oliphant et al.

[11] Patent Number: 5,761,875

[45] Date of Patent: Jun. 9, 1998

[54] REINFORCED CONCRETE POLE WITH ATTACHMENT MECHANISM

[75] Inventors: Wesley J. Oliphant, Tomball; Leo Licon, Jr., Houston; Douglas C. Sherman, The Woodlands, all of Tex.

[73] Assignee: Newmark International, Inc., The Woodlands, Tex.

[21] Appl. No.: 703,525

[22] Filed: Aug. 27, 1996

[51] Int. Cl.[6] ..... E04C 3/30

[52] U.S. Cl. ..... 52/721.2; 52/736.2; 52/736.3; 52/40; 52/721.4; 52/721.3; 52/740.6; 52/125.5; 52/704; 248/218.4

[58] Field of Search ..... 52/721.2, 736.2, 52/736.3, 40, 721.4, 724.1, 732.1, 736.1, 740.6, 721.3, 704, 699, 125.5, 726.4, 732.2; 248/218.4

[56] References Cited

U.S. PATENT DOCUMENTS

| | | | |
|---|---|---|---|
| 1,268,325 | 6/1918 | Cole | 52/297 |
| 1,777,509 | 10/1930 | Underwood | 52/721.2 X |
| 2,702,103 | 2/1955 | Pfistershamer | 52/726.4 X |
| 3,317,170 | 5/1967 | Plaff, Jr. | 52/40 X |
| 3,501,881 | 3/1970 | Van Buren | 52/721.2 X |
| 3,571,991 | 3/1971 | Doocy | 52/736.2 X |
| 4,069,629 | 1/1978 | Piazza | 52/125.5 |
| 4,320,606 | 3/1982 | GangaRao | 52/125.5 |
| 5,611,176 | 3/1997 | Juengert et al. | 52/736.2 X |

*Primary Examiner*—Carl D. Friedman
*Assistant Examiner*—W. Glenn Edwards
*Attorney, Agent, or Firm*—Wheat, Camoriano, Smith & Beres, PLC

[57] ABSTRACT

A concrete pole includes an attachment mechanism which provides a structurally sound means of attaching to the pole and permits the use of short, inexpensive bolts. It also eliminates the labor usually required for drilling or casting a hole through the pole to attach structural appurtenances to the pole with long through-bolts. The attachment mechanism includes annular members which are tied to the vertical reinforcing rods, a base plate, which is fixed to the annular members, nuts which are fixed to the base plate, and pipes, which provide a path from outside the pole, through the concrete, to the nut.

10 Claims, 4 Drawing Sheets

REINFORCED CONCRETE POLE WITH ATTACHMENT MECHANISM

BACKGROUND OF THE INVENTION

The present invention relates to concrete poles, and, in particular, to an attachment mechanism for a concrete pole which permits items to be bolted to the pole.

In the prior art, the most common way to attach structural appurtenances to a centrifugally cast concrete pole is to pass bolts completely through the pole and connect nuts to the bolts on the opposite side of the pole. This requires casting or drilling holes through the pole, which is labor intensive. Even more importantly, this means that, in order to attach anything near the base of the pole, which can have a very large diameter, very long bolts are required. These long bolts are very expensive, and, in order to be able to attach to the pole at a variety of different heights on a tapered pole, a variety of different length bolts must be stocked, which is also very expensive.

Also, since the centrifugally cast concrete poles are hollow and relatively thin-walled, the bolts are not very well supported by the pole and therefore cannot support much attachment load.

SUMMARY OF THE INVENTION

The present invention provides an attachment mechanism which does not require drilling through the concrete pole in order to attach items to the pole, thereby saving labor. Also, the present invention provides an attachment mechanism which permits a single length bolt to be used to attach items to the pole at any elevation on the pole, even though the thickness of the concrete may vary and the diameter of the pole may vary with elevation, thereby permitting the use of less expensive bolts and permitting the stocking of only a single length bolt, which saves considerable cost.

The present invention also provides an attachment mechanism which provides excellent support to anything that is bolted onto the attachment mechanism, allowing heavier loads to be attached to the pole or providing better support for the same load.

BRIEF DESCRIPTION OF THE PREFERRED EMBODIMENT

Figure 1:
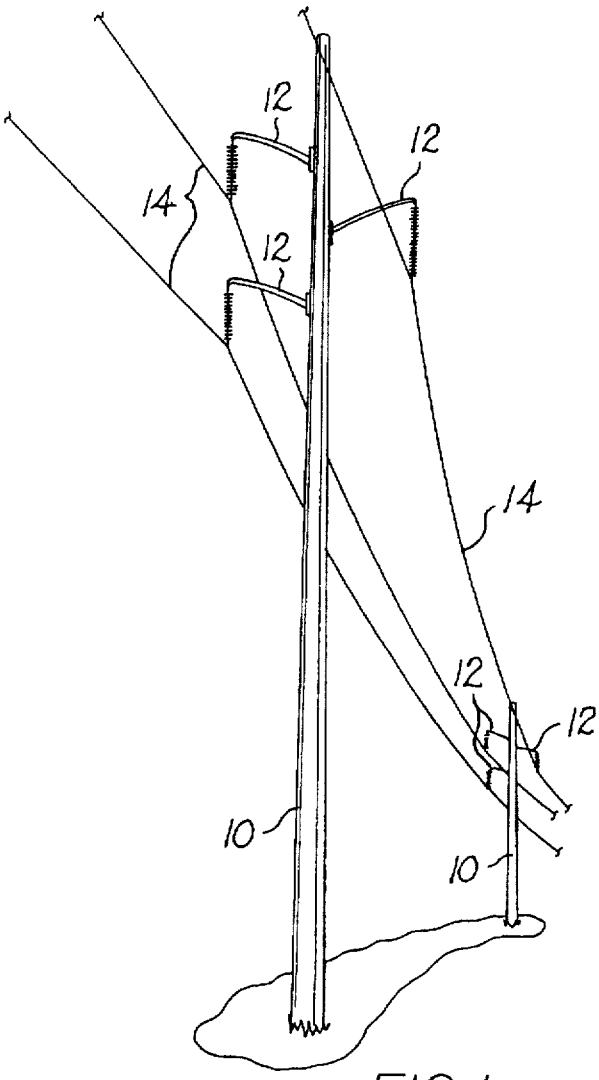
FIG. 1 shows an example of a centrifugally cast concrete pole made in accordance with the present invention, with arms attached the pole.

FIG. 1 shows an example of a plurality of concrete poles 10, used for carrying electric power. Of course, it is known that similar poles could be used for other purposes, such as to support lighting fixtures, communications antennas, signs, and other structures. In this view, each pole 10 has three arms 12 attached to the pole 10, and the arms 12 carry the power lines 14.

Figure 2:
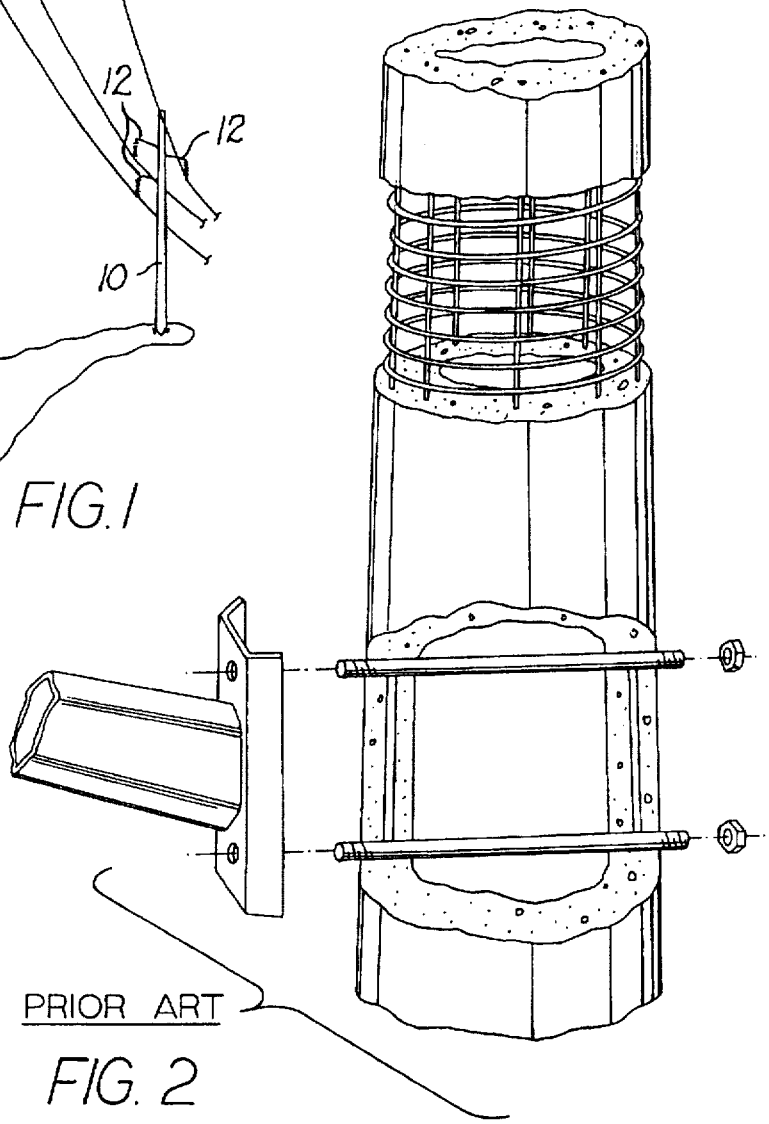
PRIOR ART FIG. 2
FIG. 2 shows a centrifugally cast concrete pole of the prior art, with vertical reinforcing rods or prestressing strands, a spiral reinforcement, and bolts extending completely through the pole in order to attach an arm to the pole.

FIG. 2 shows how the arms are typically connected to the pole in the prior art. In the prior art, holes are cast or drilled through the pole, and bolts are extended completely through the pole to connect an arm to the pole. This is labor intensive and expensive, both because it requires labor to cast or drill the holes and because very long, expensive, custom length bolts are needed to go completely through the pole, especially for attachments at the large diameter lower portions of the pole.

Figure 3:
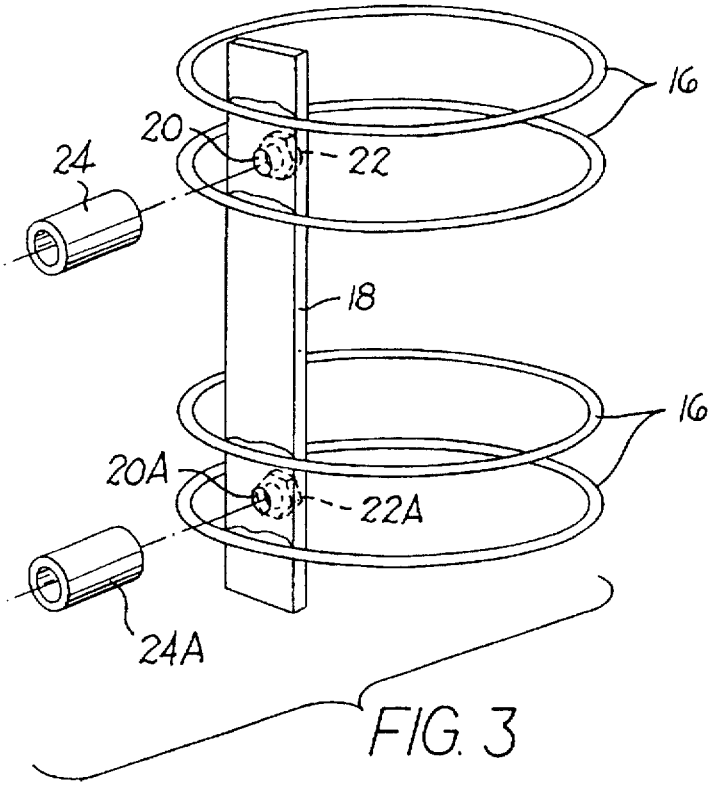
FIG. 3 shows the parts that are added to a prior art pole before the concrete is poured for the pole, in order to make a pole in accordance with the present invention.

FIG. 3 shows an example of a set of parts that can be added to a typical prior art pole, before the concrete is cast, to form the pole with an attachment mechanism in accordance with the present invention. There are four annular members or rings 16, which are preferably made of steel rods of about ⅜" diameter. This is preferably heavier than the steel rod of the spiral reinforcing in a prior art pole, which is usually made of a rod of 3/16" or 7/32" diameter. A vertical base plate 18 has four grooves cut into its outer surface to receive the four annular members 16, and the annular members 16 are welded to the base plate 18 at those grooves. The annular members 16 may alternatively be fixed to the base plate by any other known means. Between the top two rings 16, a hole 20 is drilled or punched through the base plate, and a threaded nut 22 is welded or attached by other known means to the inner surface of the base plate at the hole 20. The nut may alternatively be fixed to the base plate by being made integral with the base plate, such as by threading the hole in the base plate (not shown). Also, between the top two rings 16, a piece of pipe or a tube 24 is fixed to the outer surface of the base plate 18 and projects outwardly from the base plate 18 through the top two rings 16. The pipe 24 may be welded to the base plate, if it is made of metal, or the pipe 24 may be glued to the plate 18 or wired in place or otherwise attached in some manner long enough that the concrete will be poured around the pipe 24, leaving a path from outside the pole to the nut 22. The pipe 24 surrounds the hole 20, so that a bolt can extend through the pipe 24 and be threaded into the nut 22.

Similarly, a hole 20A is drilled or punched through the base plate between the lower two annular members 16, a nut 22A is welded or otherwise attached to the inner surface of the base plate 18 at the hole 20A, and a pipe 24A is welded or otherwise attached to the outer surface of the base plate 18 at the hole 20A, so that a bolt can extend through the pipe 24A and be threaded into the nut 22A.

Figure 4:
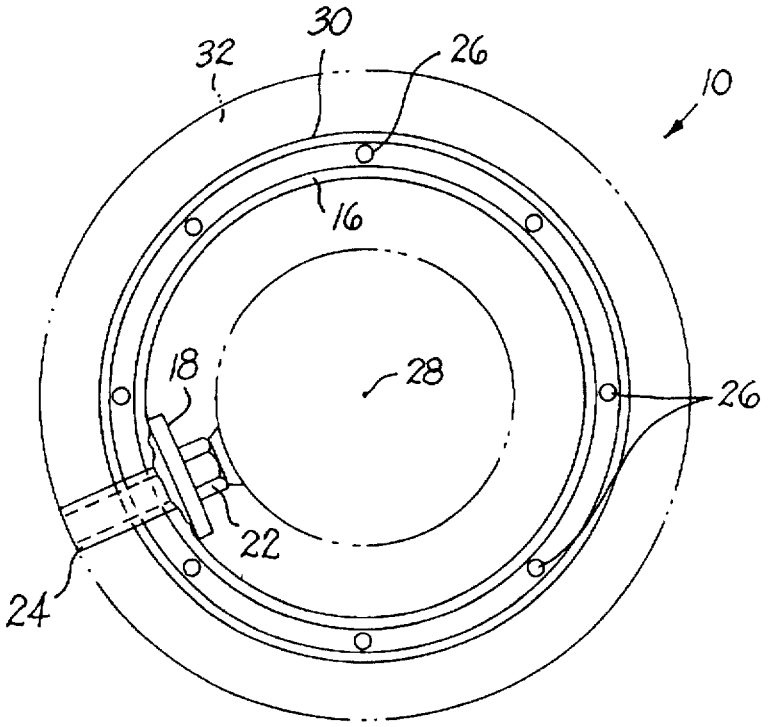
FIG. 4 is a top view of an attachment mechanism made in accordance with the present invention, using the parts of FIG. 3, with the concrete shown in phantom.
Figure 5:
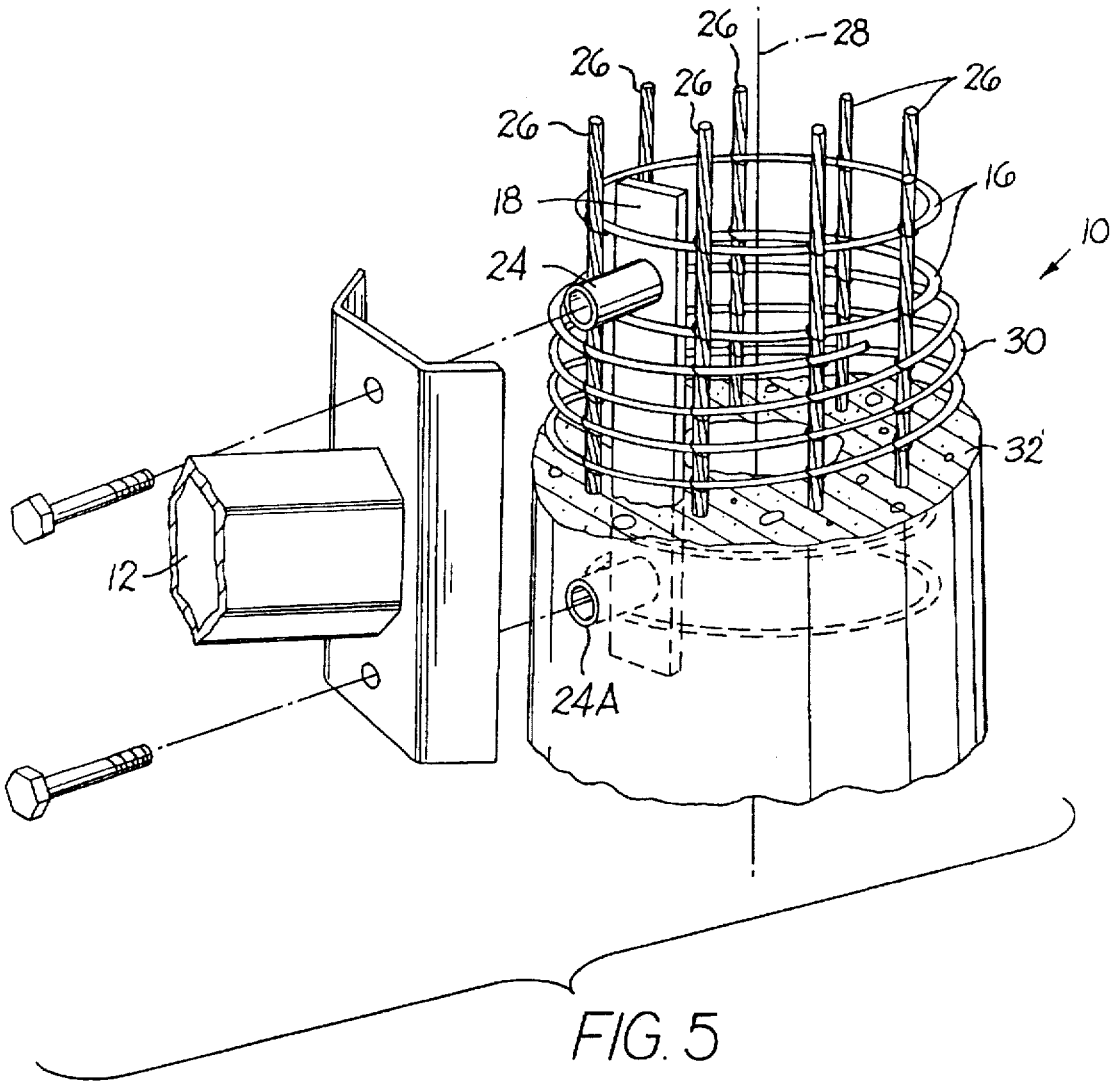
FIG. 5 is a broken-away perspective view of a concrete pole made in accordance with the present invention.
Figure 6:
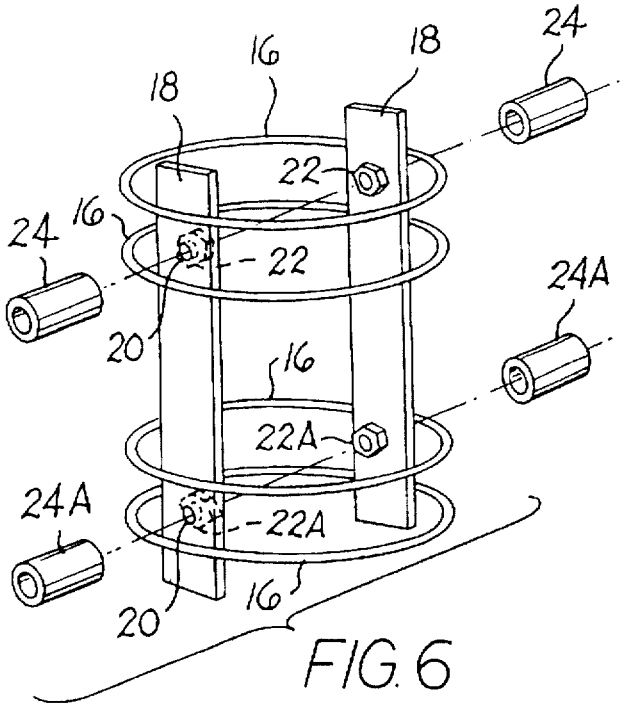
FIG. 6 shows an alternative part to the part shown in FIG. 3.
Figure 7:
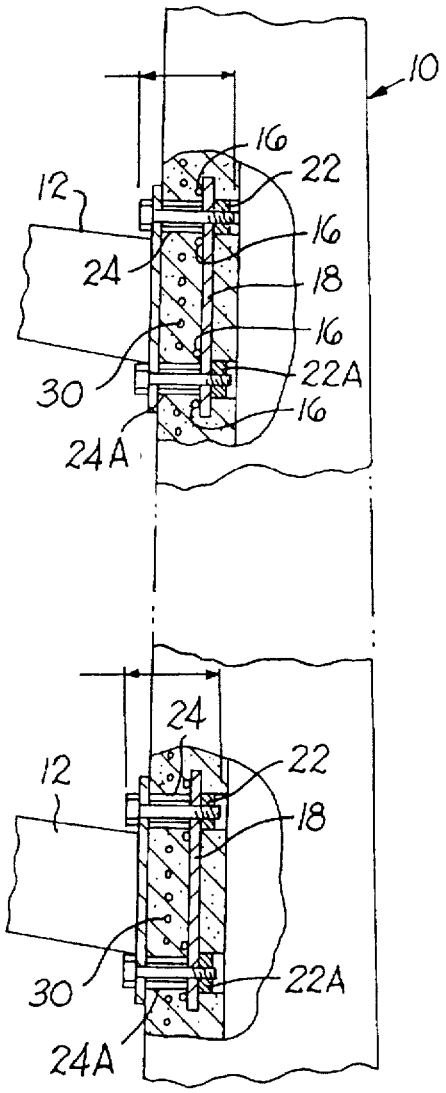
FIG. 7 is a broken-away portion of a pole made in accordance with the present invention, with two connecting mechanisms at different elevations on the pole.

The assembly of FIG. 3 is inserted into the existing reinforcing members that are normally used in making a centrifugally cast concrete pole before the concrete is cast. Looking at FIGS. 4 and 5, it can be seen that the assembly includes the vertical reinforcing steel bars or prestressing strands 26, generally referred to herein as reinforcing rods, which are spaced from each other, with all the reinforcing rods 26 being the same distance from the central axis 28 of the pole. The reinforcing rods 26 typically extend the full length of the pole 10. While the reinforcing rods 26 are referred to as vertical, they can be at a slight angle to the vertical, to account for any taper of the pole 10. The spiral reinforcing wire 30 surrounds the vertical rods 26. The annular members 16 preferably are placed inside the vertical rods 26 as shown here. The annular members 16 are coaxial with the central axis 28 of the pole 10, and, together with the vertical rods 26, form a reinforcing cage. The base plate 18 is preferably welded to the annular members 16 before the annular members 16 are inserted inside the vertical rods 26. The pipes 24 are preferably attached to the base plate 18 before the base plate 18 and annular members 16 are inserted inside the vertical rods 26, and the base plate 18 is located so that the pipes 24 can project out of the cage formed by the vertical rods 26 and the annular members 16 and through the spiral wire 30 to the mold wall (not shown). Then, the concrete 32 is cast around the vertical bars or prestressing strands 26, spiral wire 30, rings 16, base plate 18 and pipes 24, preferably by spin casting, to form a reinforced concrete pole. Several of the connector cages of FIG. 3 may be installed at various elevations of the pole, and, of course, the rings 16 will have the appropriate diameter to connect to the rods at that elevation, so that the rings 16 will have a larger diameter at the bottom of the pole than at the top of the pole, if the pole is tapered, as is common. Also, a connector cage may be used as in FIG. 6, with two or more base plates 18 on a single cage. In any case, the base plates are installed so that the distance from the nut 22 to the outside of the concrete is always the same at any elevation of the pole 10, as shown in FIG. 7. By maintaining the same distance from the outside of the pole to the nut 22, the same length bolts can always be used to connect to the pole 10, and these bolts are much shorter than any bolt that would be required to extend completely through the pole 10. This saves the cost of long, custom length bolts.

Any bolt that extends through a pipe 24 and is threaded into a nut 22 is very well-supported by the structure of the pole 10, because the base plate 18, on which the nut is fixed, is very well-supported. The base plate is prevented from moving in any direction by the concrete 32 that surrounds it and by the rings 16, the rods 26, and the concrete 32 surrounding them. Thus, the present invention provides a concrete pole with an attachment mechanism that is functionally far superior to the prior art while saving labor and material costs.

It will be obvious to those skilled in the art that modifications may be made to the embodiments described above without departing from the scope of the present invention.

What is claimed is:

1. A reinforced concrete pole, defining a central vertical axis, said pole comprising:

a plurality of vertical reinforcing rods substantially equidistant from the central vertical axis and spaced from each other;

a plurality of annular members coaxial with said vertical axis and vertically-spaced from each other, forming a reinforcing cage; said reinforcing cage having an inside surface, facing toward said central vertical axis, and an outside surface, facing away from said central vertical axis;

at least one connector, including a vertical base plate adjacent the inside surface of said reinforcing cage; at least one tubular member having first and second ends, said first end being fixed to said base plate; wherein said tubular member projects outwardly from said base plate;

a threaded nut fixed to said base plate at the first end of said tubular member;

concrete surrounding said vertical reinforcing rods and said annular members, leaving the second end of said tubular member open to the outside of the pole, so that a bolt can enter the tubular member from outside the pole and be threaded into said nut.

2. A reinforced concrete pole as recited in claim 1, wherein said base plate extends across a plurality of said annular members.

3. A reinforced concrete pole as recited in claim 2, and further comprising a second tubular member substantially identical to said one tubular member, spaced from said one tubular member and projecting outwardly from said base plate.

4. A reinforced concrete pole, defining a central vertical axis, said pole comprising:

a plurality of vertical reinforcing rods spaced from each other around said central vertical axis;

at least four horizontal coaxial annular members, supported by said plurality of vertical reinforcing rods;

a base plate fixed to said annular members;

at least one nut fixed to said base plate;

a pipe fixed to said base plate so that said nut is at one end of the pipe, said pipe projecting outwardly from said base plate; and concrete surrounding said vertical reinforcing rods, said annular members, and said pipe, with said pipe being open from the outside of said concrete so that a bolt can be put into the pipe and threaded into the nut.

5. A reinforced concrete pole as recited in claim 4, wherein there are two of said nuts fixed to said base plate and two of said pipes projecting outwardly from said base plate.

6. A reinforced concrete pole as recited in claim 5, and further comprising a spiral reinforcing wire surrounding said vertical reinforcing rods, and wherein said annular members lie inside said vertical reinforcing rods.

7. A reinforced concrete pole as recited in claim 4, and further comprising four additional horizontal annular members adjacent to said vertical reinforcing rods at a different elevation from said at least four annular members; a second base plate fixed to said four additional annular members; a second nut fixed to said second base plate; a second pipe fixed to said second base plate so that said second nut is at one end of said second pipe, said second pipe projecting outwardly from said second base plate, such that the distance from said second nut to the outer surface of the concrete is the same as the distance from the nut of the first base plate to the outer surface of the concrete, so that the same length bolts can be used to attach to the pole at any height.

8. A reinforced concrete pole, defining a central vertical axis and an outer surface, said pole comprising:

a plurality of vertical reinforcing rods spaced from each other around said central vertical axis;

at least two horizontal coaxial annular members supported by said plurality of vertical reinforcing rods;

a nut fixed to said horizontal annular members by connecting means; and a pipe fixed to said horizontal annular members by connecting means, said pipe projecting outwardly from said nut; and concrete surrounding said vertical reinforcing rods, said annular members, and said pipe, with said pipe being open from the outer surface of said concrete pole so that a bolt can be put into the pipe and threaded into the nut from outside the pole.

9. A reinforced concrete pole as recited in claim 8, and further comprising a base plate, which is fixed to said horizontal annular members, and wherein said nut and said pipe are fixed to said horizontal annular members by being fixed to said base plate.

10. A reinforced concrete pole as recited in claim 8, and further comprising a plurality of horizontal annular reinforcing members and a plurality of nuts and pipes fixed to said horizontal annular reinforcing members, with said pipes projecting outwardly to form openings from outside the pole through which bolts may be inserted into said nuts, wherein said nuts are located the same distance from the outer surface of said pole.

* * * * *